US005224519A

United States Patent [19]

Farley

[11] Patent Number: 5,224,519

[45] Date of Patent: Jul. 6, 1993

[54] METHOD AND APPARATUS FOR WEAVING A WOVEN ANGLE PLY FABRIC

[75] Inventor: Gary L. Farley, Yorktown, Va.

[73] Assignee: The United States of America as represented by the United States National Aeronautics and Space Administration, Washington, D.C.

[21] Appl. No.: 766,609

[22] Filed: Sep. 26, 1991

[51] Int. Cl.[5] ..... D03D 41/00; D03D 13/00; D03C 13/00

[52] U.S. Cl. ..... 139/11; 139/DIG. 1; 428/225

[58] Field of Search ..... 139/DIG. 1, 11, 384 R, 139/408, 22, 387 R, 16. 459, 458, 14-18, 20; 428/221, 224, 257, 225, 902

[56] References Cited

U.S. PATENT DOCUMENTS

| | | | |
|---|---|---|---|
| 1,139,073 | 5/1915 | Rhomoser | 139/459 |
| 2,244,835 | 6/1941 | Goldstein | 139/DIG. 1 |
| 4,019,540 | 4/1977 | Holman et al. . | |
| 4,046,173 | 9/1977 | Kulczycki . | |
| 4,066,104 | 1/1978 | Halton et al. . | |
| 4,140,156 | 2/1979 | Trost . | |
| 4,438,173 | 3/1984 | Trost . | |
| 4,615,256 | 10/1986 | Fukuta et al. . | |
| 5,085,252 | 2/1992 | Mohamed et al. | 139/DIG. 1 |

FOREIGN PATENT DOCUMENTS

| | | | |
|---|---|---|---|
| 46-15751 | 4/1971 | Japan | 139/11 |
| 50-20186 | 7/1975 | Japan | 139/DIG. 1 |
| 1052847 | 2/1989 | Japan . | |
| 2117418 | 10/1983 | United Kingdom | 139/DIG. 1 |
| 9014454 | 11/1990 | World Int. Prop. O. | 139/DIG. 1 |

*Primary Examiner*—Andrew M. Falik
*Attorney, Agent, or Firm*—Kevin B. Osborne

[57] ABSTRACT

Planar or multilayer structural preforms are made having yarns extending in a bias direction of the preform. Angularly directed yarns can be inserted in planar and multilayer fabrics to increase shear strength of structural preforms made from the fabrics. In multilayer fabrics, the angle yarns can extend between layers to provide through-the-thickness reinforcement. Fabrics are formed by carrying yarns transversely across the fabric as the fabric advances. Fill yarns may be inserted by an insertion technique employing a pneumatic beating element. Angle yarn feeding arrangements are made readily removable to provide for the use of other weaving assemblies.

25 Claims, 7 Drawing Sheets

METHOD AND APPARATUS FOR WEAVING A WOVEN ANGLE PLY FABRIC

ORIGIN OF THE INVENTION

The invention described herein was made by an employee of the United States government and may be manufactured or used by or for the United States government without the payment of any royalties thereon or therefor.

CROSS-REFERENCE

The present application relates to concurrently filed application Ser. No. 07/766,597, filed Sep. 26, 1991 entitled Integral Fill Yarn Insertion And Beatup Method, the specification of which is hereby incorporated by reference.

BACKGROUND OF THE INVENTION

1. Field of the Invention

This invention relates to woven products and methods and apparatus for weaving such products. It particularly relates to woven structural preforms having increased shear strength.

2. Description of Related Developments

Fiber reinforced composites have found wide applicability in the production of structural members. In the aerospace field, composites are used extensively as structural elements for aircraft and spacecraft. The strength characteristics of such structures are influenced strongly by the fiber preform from which the composite is made. Planar single layer fabrics or multilayer three dimensional fabrics having a wide variety of architectures have been used for this purpose. However, known fabric architectures do not provide the ability to resist high shear stress.

Multilayer or three dimensional woven structures which serve as preforms for structural laminates are known. Weaving apparatus for producing multilayer preforms is shown in U.S. Pat. No. 4,019,540 to Holman et al. However, woven structures made in accordance with the teachings of the Holman et al patent do not provide sufficient shear strength or shear stiffness, especially for many aerospace applications. U.S. Pat. No. 4,615,256 to Fukuta et al shows the formation of three dimensional structures by utilizing braiding techniques. However, the process described in this patent is slow and extremely costly and requires equipment of significant size to make preform structures having useful dimensions.

To provide improved shear strength characteristics, triaxial weaving has been proposed, as shown, for example, in U.S. Pat. No. 4,046,173 to Kulczycki, U.S. Pat. No. 4,066,104 to Halton et al, U.S. Pat. No. 4,140,156 to Trost and U.S. Pat. No. 4,438,173 to Trost. The fiber orientations producible by triaxial machines are very limited. Because the process dictates the preform architecture, it is difficult to meet diverse structural demands. Triaxial processes can produce only a single layer fabric and not a multilayer fabric. The fiber architecture resulting from triaxial weaving is very porous and the yarns are heavily crimped. These factors limit the applicability of triaxially woven preforms for aerospace composite applications.

SUMMARY OF THE INVENTION

It is an object of the invention to provide single and multilayer woven fabrics having enhanced shear strength and stiffness.

It is a further object of the invention to provide fabric preforms for fiber resin reinforced composite structures having improved strength properties.

It is a further object of the invention to provide weaving methods and apparatus for making woven products having improved shear strength.

These and other objects of the invention are accomplished by a woven fabric having an angularly disposed ply or plies of yarn which extend in one or more bias directions in the fabric. The angularly disposed plies of yarn are inserted in the fabric by a plurality of yarn carrying members that are moved transversely to the warp sheets as the warp sheets advance through a loom. Ends of the angularly inserted yarns are woven into the selvage edge of the fabric or releasably held on movable members at the edge of the fabric. Each angle yarn insertion member carries a supply of yarn or yarns movable with the carrier.

DESCRIPTION OF THE PREFERRED EMBODIMENTS

Figure 1:
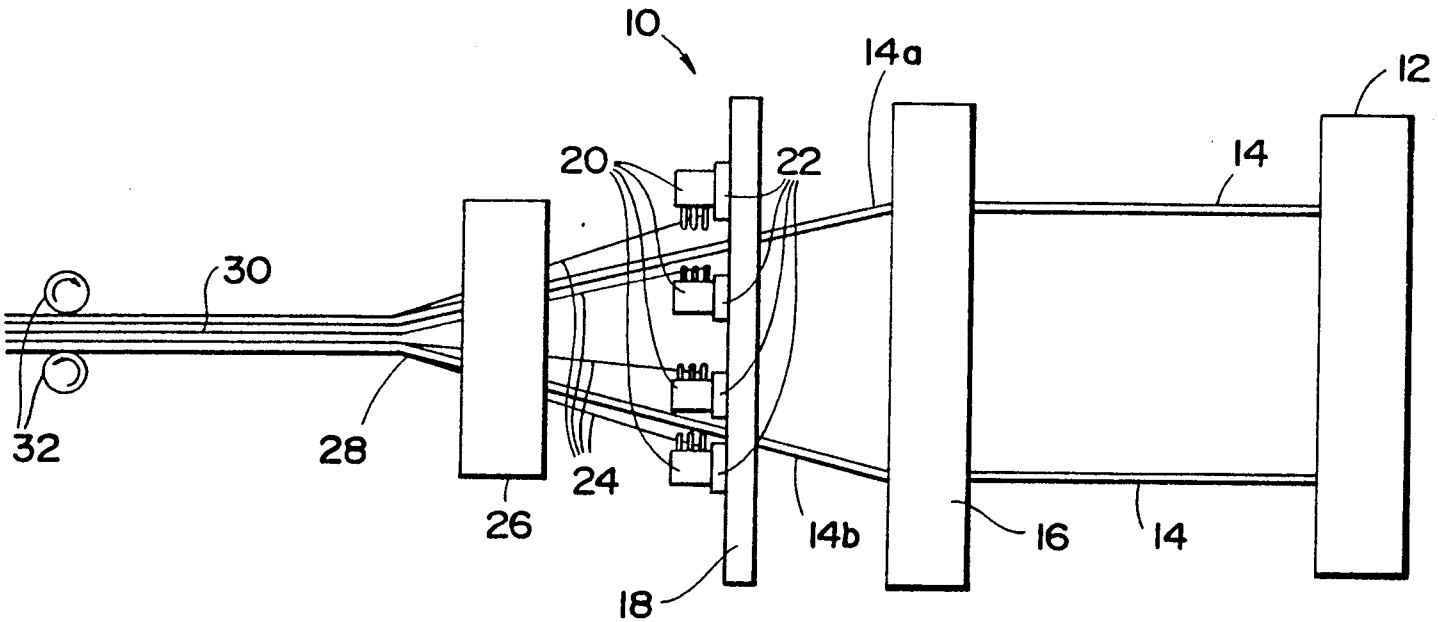
FIG. 1 is a schematic side view of a loom for weaving angle ply fabrics and multilayer preforms.

FIG. 1 shows a multi-harness loom 10 for producing angle ply fabrics in accordance with the present invention. The loom includes a fiber creel/warp beam assembly 12 from which the warp yarns 14 are supplied. The warp yarns 14 extend to a multi-harness head 16 and form a plurality of sheets of warp yarns **14*a* and 14*b*. Although only two such sheets are shown in FIG. 1**, it should be understood that a greater number of warp sheets can be formed in this apparatus for producing multilayer preforms.

The loom 10 includes an angle ply weaving assembly 18 that carries one or more needle holders 20 which are mounted to move transversely on transversely extending needle holder racks 22. The needle holders 20 provide a plurality of angle ply yarns 24 which will be described hereafter in more detail. The warp yarns 14 and angle ply yarns 24 extend to a fill yarn insertion unit 26. The unit 26 inserts a fill yarn into the beginning 28 of the fell 30, as will be described later. The fell 30 is drawn from loom 10 by takeoff rollers 32.

Figure 2:
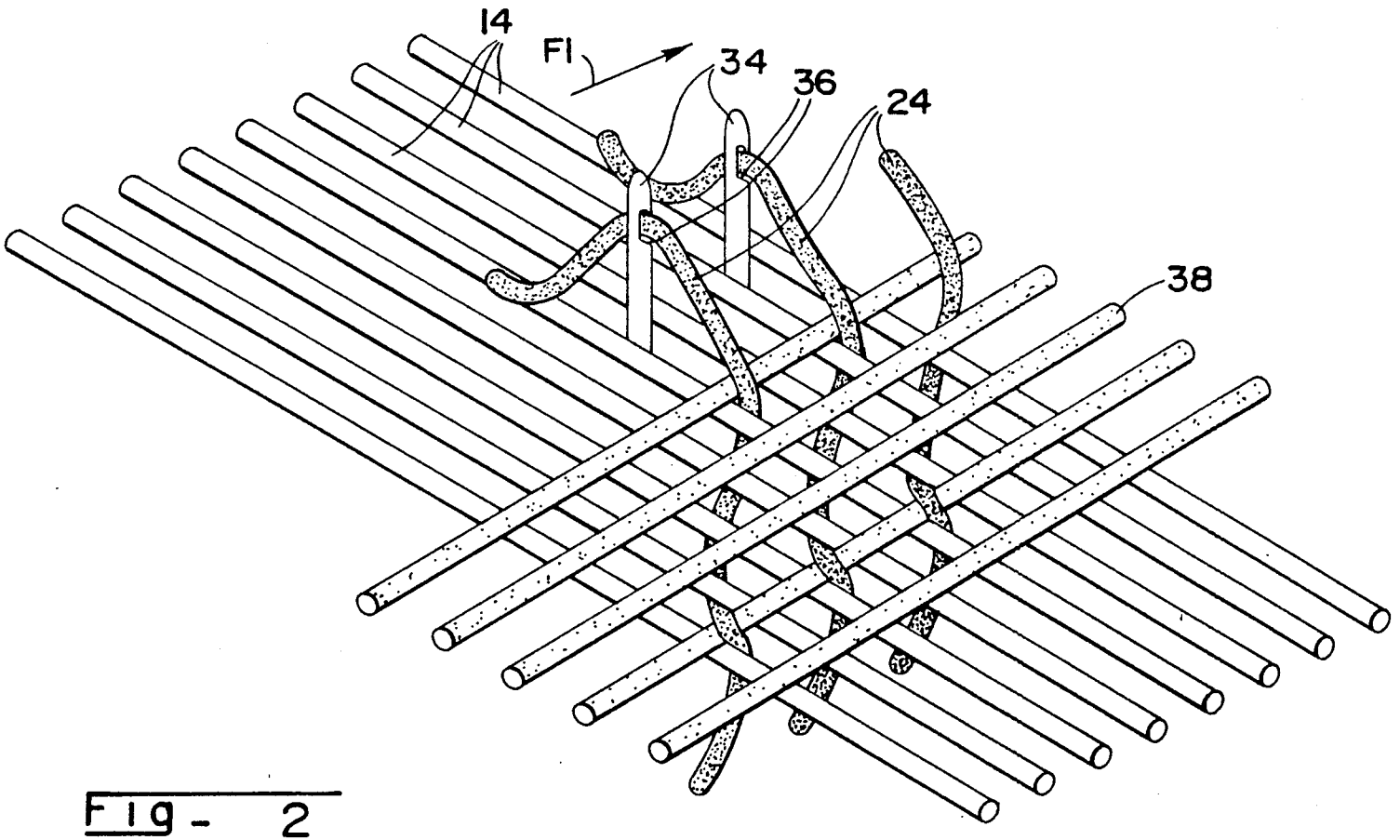
FIG. 2 is a perspective view of an angle ply weaving operation.

In FIG. 2, formation of a basic angle ply fabric or one layer of a multilayer preform is illustrated. As is conventional, the warp yarns 14 extend in a parallel fashion to form a sheet. A plurality of reciprocable needles 34 (only two of which are shown in FIG. 2 for purposes of simplicity) are positioned to reciprocate through spaces between the warp yarns. Needles 34 may be placed between each adjacent pair of warp yarns or may be spaced a predetermined number of warp yarns apart, depending upon the number of angle yarns 24 required by the fabric architecture. The needles 34 include yarn receiving openings or slots 36. When the needles are reciprocated, the angle yarns 24 are positioned on one side or the other of the warp sheet. During the weaving operation, the needles 34 move successively across the warp sheet in a transverse direction so that the angle yarns 24 extend in a bias direction of the fabric. The angle at which the angle yarns are disposed in the fabric with respect to the warp yarns 14 is dependent upon the relationship between the longitudinal speed of the warp yarns 14 and the rate of transverse movement of the needles 34. If the transverse needle movement rate in the direction of arrow $F_1$ is low, a relatively small angle is formed between the angle yarns 24 and the warp yarns 14. Conversely, if the rate of transverse movement of the needles 34 in the direction of arrow $F_1$ is high, then a substantially greater angle between the angle yarns 24 and the warp yarns 14 is formed.

As shown in FIG. 2, the fill yarns 38 are inserted transversely or orthogonally to the warp yarns 14. The fill yarns 38 are beaten into a fabric that includes both the warp yarns 14 and the angle yarns 24. Because of the presence of the angle yarns 24, conventional reeds cannot be used to beat in the fill yarns. Instead, the fill yarns 38 are inserted into the fabric by a beat up apparatus and method which is described further herein in connection with FIGS. 5, 5A and FIGS. 6A-6E. By raising and lowering the needles 34 with respect to the warp sheet, the angle ply yarns 24 can be interlocked with the warp and fill yarns. As the fill yarns 38 are beaten into the fabric at the beginning of the fell, the fabric is advanced.

It should further be realized that additional plies of angle yarns 24 can be woven into the fabric by a second group of needles which extend oppositely to the upwardly directed needles 34 and which are successively carried across the fabric in a transverse direction opposite to arrow $F_1$. The needles 34 can be extended periodically to form a shed, analogous to the raising and lowering of warp yarns in conventional weaving. In a multilayer preform, the needles 34 can be reciprocated between adjacent warp sheets to lock adjacent layers together. One or more angle yarn plies can be provided for each sheet of warp yarns.

Figure 3:
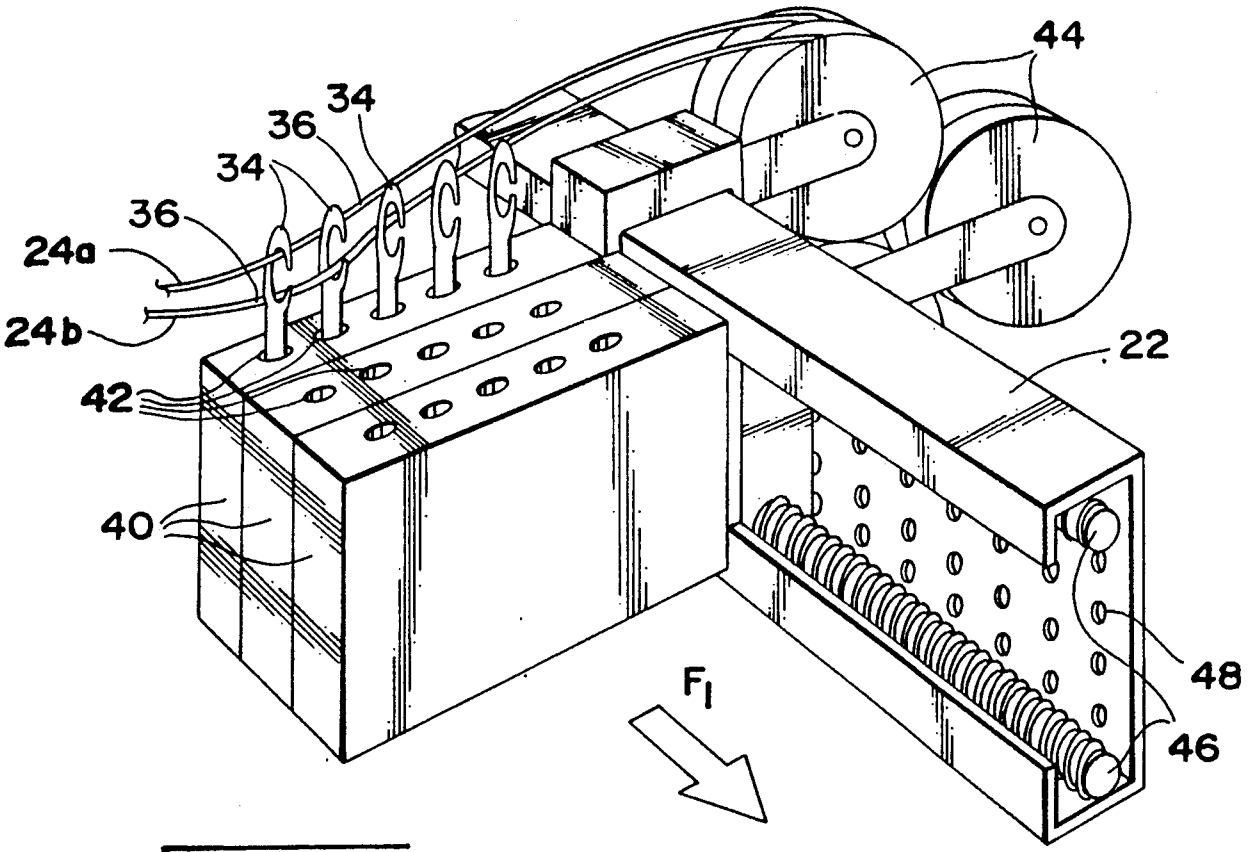
FIG. 3 is a perspective view of a needle holder assembly for inserting angle ply yarns.

FIG. 3 illustrates a unit for inserting angle ply yarns. The yarn insertion unit includes a plurality of transversely movable needle holders 40, the number and width of which are governed by the desired fabric architecture. Each needle holder includes one or more bores 42 for receiving a group of needles 34. The number of bores 42 in which angle ply needles 34 are received is governed by the desired fabric architecture, including the desired density of angle ply yarns in the fabric.

The needle holders 40 are movable transversely in the direction of arrow $F_1$. To provide such movement, the blocks 40 are slidably received in the needle block rack 22, so that the needle holders can be moved in the direction of arrow $F_1$ or in a direction reverse to arrow $F_1$. To effect such transverse movement, suitable drive means, such as rotating threaded rods 46 are provided. Each block 40 includes structure for engaging the rods 46 as the rods are rotated, so that the needle holders move along the rack 22 by rotation of the rods 46.

A supply of angle yarns is associated with each of the needle holders 40 and is carried as a unit with the needle holder 40 as the needle holder moves transversely. As shown in FIG. 3, the angle yarn supply can comprise a plurality of prewound spools 44 that supply angle yarn ends **24*a*, 24*b*. The spools 44 may include integral tensioning elements, such as biasing springs, to provide the desired tensioning or wind up for the angle yarns 24. Each individual angle yarn end is received in a yarn receiving slot 36 in one of the needles 34**.

The needles 34 reciprocate with respect to the needle holders 40. Such reciprocation can be effected by a pneumatic cylinder (not shown) in each of the bores 42. The air supply to an air cylinder in each of the bores 42 can be provided through a plurality of ports 48, one in each vertical row for each cylinder, extending through the back surface of the rack 22. In this case, each of the needle blocks 40 includes corresponding ports and sealing means for forming an airtight connection with the ports 48. Other electromagnetic or other electromechanical systems could also be utilized to reciprocate needles 34.

When the needle carriers 40 move to the end of the rack 22, the needle holder assembly is removed and, if necessary, a new supply of yarns is mounted and inserted into the needles. The needle mounting assembly is then remounted at the beginning of the track to repeat the operation. The ends of the angle yarns can be fixed by being woven into the selvage of the preform or can be attached to a moving edge system shown in FIG. 7 and described in connection therewith.

Figure 4A:
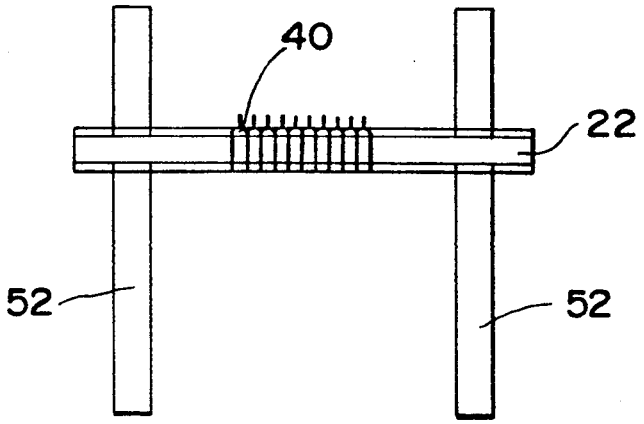
FIG. 4A is a schematic view showing the needle rack for the needle holders in operative position.
Figure 4B:
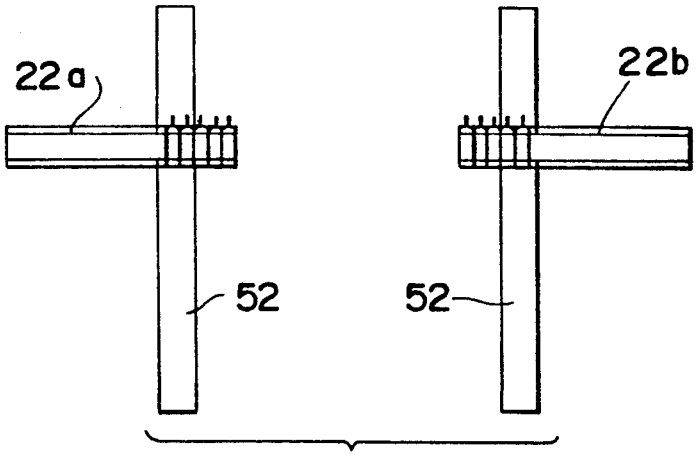
FIG. 4B is a schematic illustration of the needle rack shown in FIG. 4A, withdrawn from operative position.

When weaving complex preforms, such as stiffened panels, it is advantageous to be able to remove the needle rack assembly 22 from the weaving region to facilitate other weaving operations. FIGS. 4A and 4B illustrate an arrangement for allowing such removal. In operation, the needle rack assembly 22 is held in position by a pair of vertical supports 52. Needle holders 40 are shown disposed on the rack 22. As illustrated in FIG. 4B, the rack 22 comprises two separable sections **22*a* and 22*b* which can be releasably jointed together at the center and which are movable transversely with respect to the vertical supports 52. In this manner, the needle rack 22 can be removed and reinstalled without removal of angle yarns from the needles 34 or separation of these yarns from the woven preform. Suitable interfitting means (not shown) are used for joining the rack sections 22*a* and 22*b* and coupling the rods 46 (FIG. 3) together to assure alignment so that the needle holders can move without interruption across the joint between sections 22*a* and 22*b***.

Figure 5:
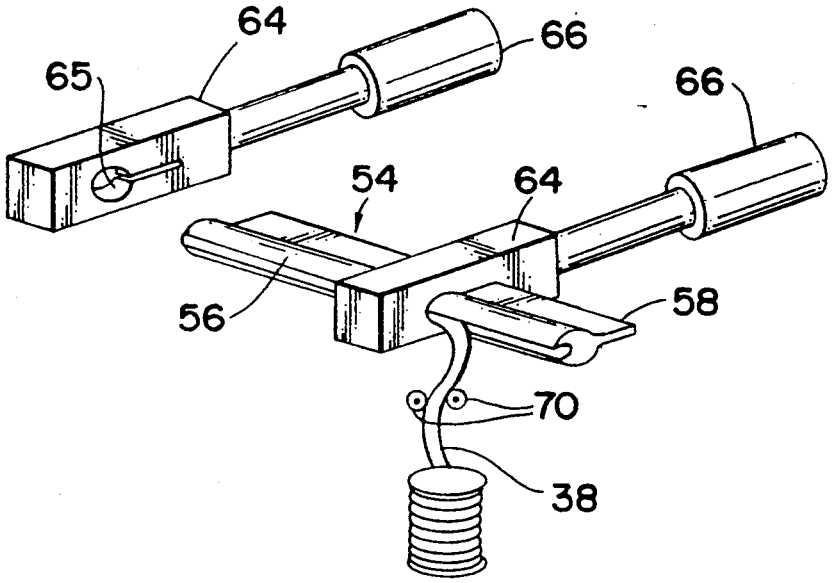
FIG. 5 is a schematic view of a rapier assembly for inserting fill yarns into the fell of the fabric.
Figure 5A:
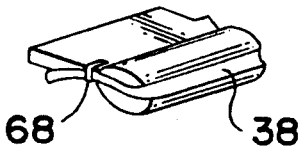
FIG. 5A is a partial detail view of an end of the rapier assembly showing the securing of a fill yarn end.
Figures 6A, 6B, 6C, 6D, 6E:
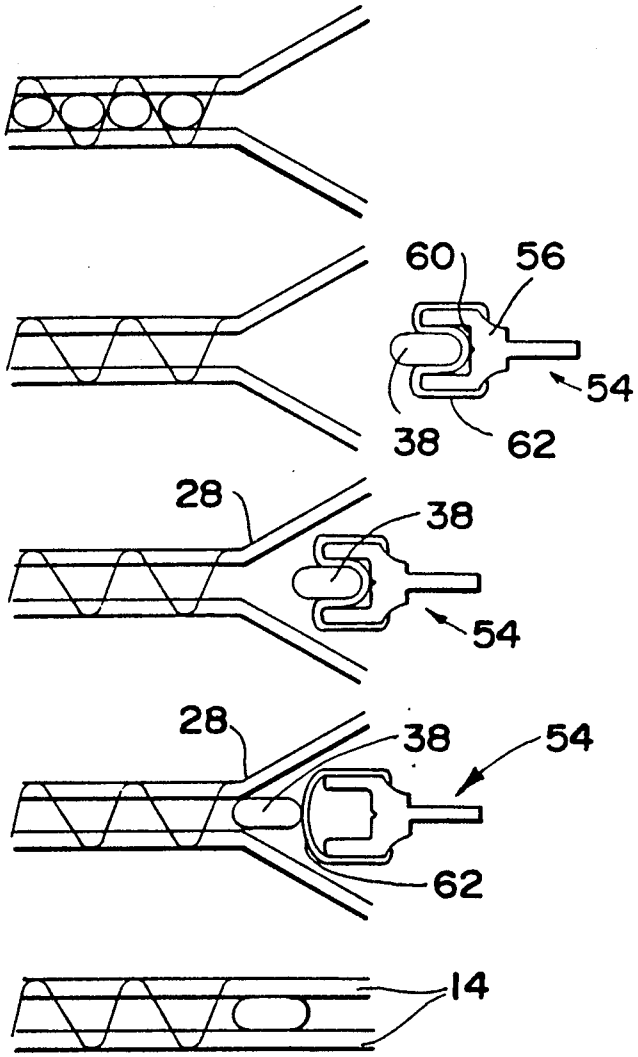
FIGS. 6A–E schematically illustrate insertion of a fill yarn by operation of the rapier assembly shown in FIG. 5.

In the conventional weaving process, after the shed is formed and the fill yarn is inserted, the reed beats the fill yarn into the fell. The use of the reed for fabric beat up in conventional weaving is convenient because of the orthogonality of the weaving yarns. The reed positions the fill yarn in the fell and, to a limited extent, straightens the fill yarn. However, the inclusion of angle ply yarns renders a conventional reed less useful for fill yarn beating. In order to provide for insertion of the fill yarn, an insertion unit as shown in FIGS. 5, 5A and 6 is desirable. A beat-in unit suitable for this purpose is disclosed in a U.S. patent application Ser. No. 07/766,597, filed Sep. 26, 1991, the disclosure of which is incorporated herein by reference. In this arrangement, an elongate removable element 54 termed a "rapier" is utilized. The rapier 54 includes an enlarged front section 56 and a flat tail section 58. A fill yarn channel 60 is formed along the front edge of the rapier. The leading portion of the front section 56 carries a rubber boot 62 that extends from the top edge of the rapier, across and into the channel 60 to the bottom of the rapier, as shown in FIGS. 6B, 6C and 6D. The fill yarn beating assembly further includes a pair of spaced rapier receiving members 64 each of which has an opening 65 through which the rapier 54 is inserted. The receiving elements 64 are driven by a pair of hydraulic actuators 66 that alternately advance and retract the rapier 54 toward and away from the beginning of the fell 28.

In operation, a fill yarn 38 is secured at one edge of the rapier by suitable means, such as a clip 68 (FIG. 5A). The fill yarn is then inserted into the boot-covered channel 60 formed along the front edge of the rapier 54. The rapier 54 is then slid transversely through an opening 65 in the first of the rapier receiving elements 64 and then through a like opening 65 in the other transversely displaced rapier receiving element 64. The distance between the rapier receiving elements 64 is substantially equal to the width of the fabric being woven. As shown in FIG. 5, an opening 65 can be utilized to force the fill yarn 38 into the channel 60 as the rapier 54 is being pushed transversely through the receiver element 64.

FIG. 6A shows the fell open before insertion of a fill yarn 38. FIG. 6B shows the rapier 54 in the loading position with a fill yarn 38 disposed in the groove 60. FIG. 6C shows the position of the rapier 34 as the hydraulic actuators 66 position the rapier adjacent the beginning 28 of the fell. At this position, the boot 62 is inflated, as shown in FIG. 6D, thereby pushing the fill yarn 38 into the fell. The rapier 54 is then withdrawn and the fell is closed, as shown in FIG. 6E.

By use of the pneumatic beating operation discussed above, the fill yarn 38 can be beaten into the fell, despite the fact that orthogonality of the fill yarn to the warp yarns cannot be achieved because of the presence of the angle yarns. The pneumatic boot 62 provides a constant, even pressure across the width of the fell for reliably inserting the fill yarn. It should be realized that for multiple layer fabrics, a number of rapiers 54 can be provided in accordance with the number of fill yarns required. Alternately, a single rapier which is vertically movable can be used and the process is repeated until all of the fill yarns through the thickness are inserted. When all of the fill yarns have been inserted, the fabric is advanced.

An important feature of the foregoing process is that the fill yarn is tensioned as it is held in the rapier prior to insertion. Such tensioning is accomplished in the disclosed system by reason of the fact that one end of the fill yarn 38 is held at one edge of the rapier and the other is engaged in a tensioning element, such as a pair of tension rollers 70.

Figure 7:
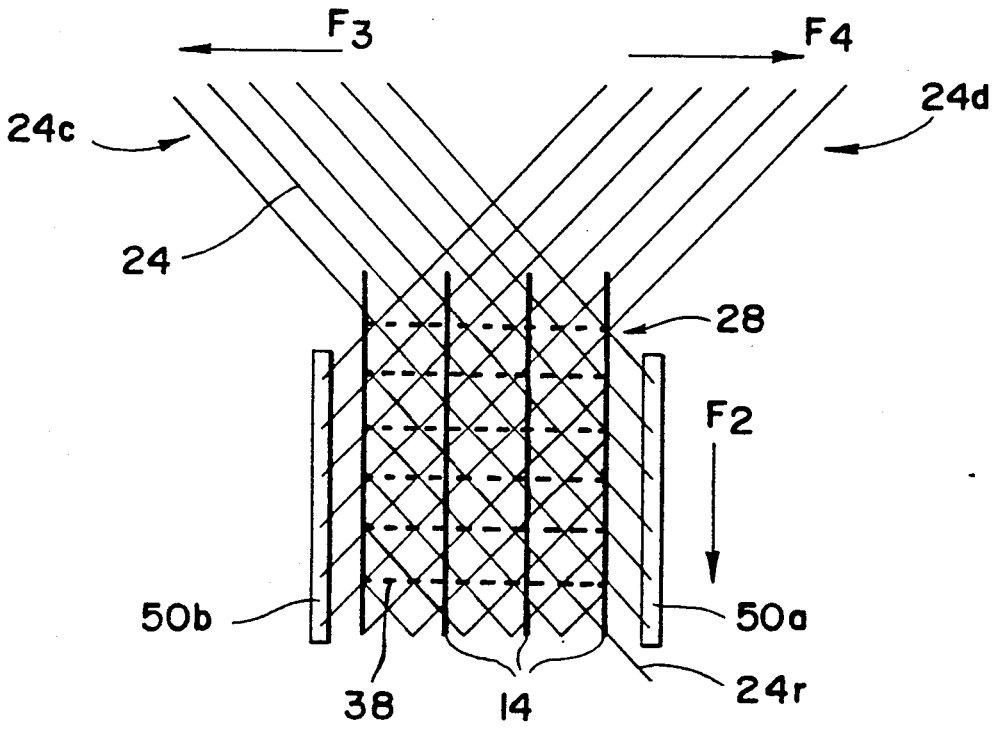
FIG. 7 is a schematic illustration of weaving angle ply yarns with movable edge supports.

FIG. 7 is a schematic plan view showing a basic arrangement for forming fabrics in accordance with the invention. In this arrangement, the fabric is moving in the direction of arrow $F_2$ and includes warp yarns 14, fill yarns 38, and two plies of angle yarns, **24*c* and 24*d*. Angle ply 24*c* is formed by needle carriers moving in the direction of arrow $F_3$ and angle ply 24*d*** is formed by needle carriers moving in the direction of arrow $F_4$.

In the FIG. 7 arrangement, a pair of moving belts **50*a* and 50*b* is mounted adjacent respective side edges of the fell. The moving edge support provided by the belts 50*a* and 50*b* can be provided by a so-called "sticky belt", having a surface with a permanent tack that will releasably hold the ends of the angle ply yarns. As successive portions of the fabric are completed, the angle yarn is released or pulled from the belt, as illustrated by angle yarn end 24*r* in FIG. 7. Similarly, the belts 50*a* and 50*b* could be provided with fabric hook type fasteners, such as those sold under the trademark Velcro. Alternatively, the ends of the yarn forming the plies 24*c* and 24*d*** can be held by being woven into the selvage of the fabric.

Figure 8:
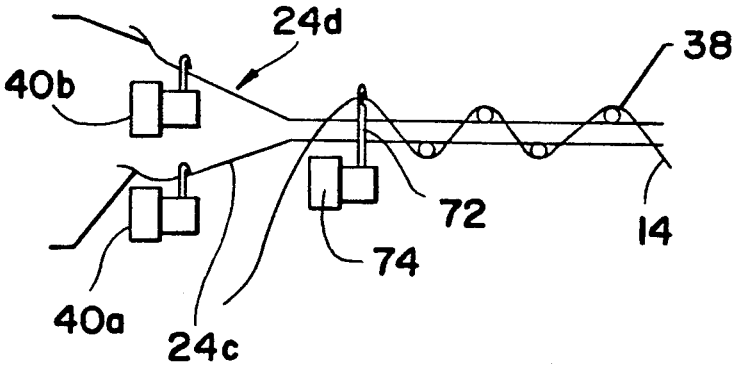
FIG. 8 is a cross sectional view of the weaving operation utilizing warp yarns for interlocking angle yarn plies and fill yarns.

FIG. 8 shows another arrangement for forming angle ply fabrics. In this arrangement, the angle ply or plies are formed, as shown in FIG. 7, by oppositely moving angle yarn needle holder **40*a* and 40*b* and an extendible warp needle 72 is positioned adjacent the beginning of the fell. The warp needle 72 is reciprocated vertically to place the warp yarn 14 above the angle ply 24*c* or below the angle ply 24*d*. In this manner, the warp yarns can be utilized to interlock the angle yarns and the fill yarns 38** to form the fabric.

A control system for the operations described can be implemented in a conventional manner. Microprocessor-based control systems for looms are known and can be utilized to control the angle yarn insertion mechanism and the fill yarn beat in assembly.

The weaving method and apparatus described above can be used to weave single and multilayer structural preforms with fibers oriented along the bias direction of the preform, in addition to having fibers in the conventional warp/fill and through-the-thickness directions. A suitable system for weaving such fabrics can be integrated with conventional multi-harness looms without resorting to complex mechanisms.

Weaving fibers along the bias of a preform results in significant increase in shear strength and stiffness, thereby increasing the value of the preform as a structural member. Decorative fabrics can also be made utilizing the equipment and techniques described.

What is claimed is:

1. Weaving apparatus comprising:

a unit for forming a first sheet of substantially parallel warp yarns;

a unit for forming a second sheet of substantially parallel warp yarns;

means for moving the sheets of warp yarns with respect to each other to form a shed;

a member for inserting fill yarns transversely of the warp yarns into the shed; and a unit for inserting an interlocked angle yarn at an angle across the first sheet of warp yarns, the fill yarns and the second sheet of warp yarns.

2. Apparatus as in claim 1, wherein the angle yarn inserting unit comprises:

a placement member for placing the angle yarn between adjacent warp yarns in at least one of the first and second warp yarns sheets; and an angle yarn supply.

3. Apparatus as in claim 2, wherein said angle yarn inserting unit comprises means for moving the yarn placement member between a first side of said one of the sheets of warp yarns and on a second side of said one of the sheets of warp yarns.

4. Apparatus as in claim 2, further comprising a mounting system for moving the yarn inserting unit transversely with respect to the warp yarn sheets.

5. Apparatus as in claim 4, wherein the angle yarn inserting unit comprises:

a needle having an opening for receiving the angle yarn and means for moving the opening through one of the sheets of warp yarns.

6. Apparatus as in claim 5, wherein the angle yarn inserting unit comprises:

a plurality of needles, each needle having an opening for receiving an angle yarn; and means for moving each opening through one of the sheets of warp yarns.

7. Apparatus as in claim 1, wherein the unit for inserting the angle yarn comprises:

a rack extending transversely of the first sheet of warp yarns;

a carrier mounted on the rack;

a drive system for moving the carrier along the rack;

a placement member on the carrier for carrying the angle yarn; and a drive element associated with the placement member for selectively disposing the angle yarn on one side or the other side of the first sheet of warp yarns.

8. Apparatus as in claim 7, wherein the rack comprises:

a first section;

a second section; and means for mounting the first section and the second section for movement toward or away from each other.

9. Weaving apparatus comprising:

a supply system for providing an array of warp yarns;

a fill yarn placement member for placing fill yarns substantially orthogonal to the warp yarns;

a unit for placing first angle yarns with the warp yarns and the fill yarns, said angle yarns being disposed angularly with respect to the warp and the fill yarns in a plane defined by the warp yarns and the fill yarns, wherein the angle yarn placing unit comprises a first yarn carrying member and a drive system for moving the yarn carrying member transversely with respect to the array of warp yarns;

means for effecting relative movement between the angle yarns and the warp yarns for interlocking the warp yarns, the angle yarns and the fill yarns, wherein the angle yarns are disposed angularly with respect to the warp yarns and the fill yarns in a plane defined by the warp and fill yarns; and a first support disposed outboard of a first edge of the array of warp yarns for releasably engaging an end of said angle yarn.

10. Apparatus as in claim 9, wherein the first support for releasably engaging an end of said angle yarn comprises a movable belt.

11. Apparatus as in claim 10, wherein the movable belt comprises a tacky surface for releasably engaging the angle yarn end.

12. Apparatus as in claim 10, wherein the belt comprises hook fasteners for releasably engaging the angle yarn end.

13. Apparatus as in claim 9, further comprising:

a second support for releasably engaging an end of an angle yarn disposed outboard of a second edge of the array of warp yarns, said second edge being opposite the first edge; and a second unit for placing a second angle yarn interlocked with the warp yarns and fill yarn, with the second angle yarn being disposed at an angle with respect to the first angle yarn and in the same plane.

14. Apparatus as in claim 13, wherein the second unit for placing the second angle yarn comprises a second yarn carrying member and second drive system for moving the second yarn carrying member transversely with respect to the array of warp yarns in a direction opposed to the direction of movement of the first yarn carrying member.

15. Apparatus as in claim 9, wherein the interlocking means can vary the position of a warp yarn with respect to the angle yarn and the fill yarn.

16. Apparatus as in claim 9, wherein the interlocking means can vary the position of the angle yarn with respect to the warp yarns and the fill yarn.

17. A method of forming a fabric comprising the steps of:

establishing a sheet of warp yarn;

disposing a fill yarn substantially transversely to the warp yarns;

disposing an angle yarn extending in a bias direction with the warp and fill yarns;

moving the angle yarn relative to the warp layers such that the angle yarn is in an interlocked relationship with the warp yarn and the fill yarn; and securing an end of the angle yarn at an edge of the warp yarn, wherein the step of securing the end of the angle yarn comprises releasably engaging said end on a member movable with the warp yarns.

18. The method of claim 17, further comprising the step of moving the angle yarn transversely of the warp yarn as the fabric is formed.

19. A method as in claim 17, wherein the step of securing the end of the angle yarn comprises weaving the end in a selvage portion of the fabric.

20. A method of forming a fabric comprising the steps of:

establishing a first sheet of warp yarns;

establishing a second sheet of warp yarns;

forming a shed with the first and second sheets of warp yarns;

inserting a fill yarn in said shed to form a first fabric; and inserting an angle yarn extending in a bias direction to the warp yarns and fill yarn in said first fabric while successively drawing the angle yarn transversely with respect to the sheets of warp yarns as fill yarns are inserted in the fabric.

21. A method as in claim 20, further comprising the step of interlocking the angle yarn with the warp and fill yarns.

22. A method as in claim 21, wherein the step of joining the first and second fabrics comprises utilizing at least one of the angle yarns to join the first and second fabrics.

23. A method as in claim 20, further comprising the steps of:

establishing a third sheet of warp yarns;

establishing a fourth sheet of warp yarns;

forming a shed with the third and fourth sheets of warp yarns;

inserting a fill yarn in the shed form by the third and fourth sheets of warp yearns to form a second fabric;

inserting a second angle yarn extending in a bias direction to the warp yarns and fill yarn in said second fabric; and joining the first fabric to the second fabric to form a multilayer structure.

24. Weaving apparatus comprising:

a supply system for providing an array of warp yarns;

a fill yarn placement member for placing fill yarns substantially orthogonal to the warp yarns;

a unit for placing first angle yarns with the warp yarns and the fill yarns, said angle yarns being disposed angularly with respect to the warp and the fill yarns in a plane defined by the warp yarns and the fill yarns; and means for effecting relative movement between the angle yarns and the warp yarns for interlocking the warp yarns, the angle yarns and the fill yarns, wherein the angle yarns are disposed angularly with respect to the warp yarns and the fill yarns in a plane defined by the warp and fill yarns, wherein the effecting and interlocking means can vary the position of a warp yarn with respect to the angle yarn and the fill yarn.

25. Weaving apparatus comprising:

a supply system for providing an array of warp yarns;

a fill yarn placement member for placing fill yarns substantially orthogonal to the warp yarns;

a unit for placing first angle yarns with the warp yarns and the fill yarns, said angle yarns being disposed angularly with respect to the warp and the fill yarns in a plane defined by the warp yarns and the fill yarns; and means for effecting relative movement between the angle yarns and the warp yarns for interlocking the warp yarns, the angle yarns and the fill yarns, wherein the angle yarns are disposed angularly with respect to the warp yarns and the fill yarns in a plane defined by the warp and fill yarns, wherein the effecting and interlocking means can vary the position of the angle yarn with respect to the warp yarns and the fill yarn.

* * * * *